US005951150A

United States Patent [19]

Helstern

[11] Patent Number: 5,951,150

[45] Date of Patent: Sep. 14, 1999

[54] DISPLAY SYSTEM

[75] Inventor: Robert Patrick Helstern, Costa Mesa, Calif.

[73] Assignee: Eaton Corporation, Cleveland, Ohio

[21] Appl. No.: 08/927,951

[22] Filed: Sep. 11, 1997

[51] Int. Cl.[6] ..... F21V 9/10

[52] U.S. Cl. ..... 362/293; 362/231; 362/242; 362/246; 362/248; 40/581

[58] Field of Search ..... 40/444, 577, 581, 40/582, 564; 362/230, 231, 293, 242, 246, 248

[56] References Cited

U.S. PATENT DOCUMENTS

| | | | |
|---|---|---|---|
| 1,064,911 | 6/1913 | Jarvis | 40/581 |
| 2,168,113 | 8/1939 | Best | 40/444 |
| 2,169,022 | 8/1939 | Chubb | 362/231 |
| 5,097,258 | 3/1992 | Iwaki | 362/231 |
| 5,295,050 | 3/1994 | Helstern et al. | 362/27 |

*Primary Examiner*—Alan Cariaso
*Attorney, Agent, or Firm*—Tarolli, Sundheim, Covell, Tummino & Szabo

[57] ABSTRACT

A display system includes a plurality of color filters disposed between a plurality of light sources and a display panel. A first light source is energizeable to transmit light through a first color filter to illuminate the display panel with a first color (red). A second light source is energizeable to transmit light through a second color filter to illuminate the display panel with a second color (green). The first and second light sources are simultaneously energizeable to transmit light through both of the color filters to illuminate the display panel with a third color (yellow). The display panel includes inner and outer layers containing light absorbing pigment and light scattering particulate. The outer layer of the panel contains a greater quantity of pigment than the inner layer. The inner layer of the panel contains a greater quantity of light scattering particulate than the outer layer. The inner and outer layers of the panel have the same optical density.

5 Claims, 2 Drawing Sheets

DISPLAY SYSTEM

BACKGROUND OF THE INVENTION

The present invention relates to a display system which is capable of being illuminated with different colors.

Display systems are commonly utilized in association with push-button actuated switches, annunciators, and signaling devices. A known display system is disclosed in U.S. Pat. No. 5,295,050. This known display system is constructed so as to be readable in bright sunlight. The display system includes a prism having a pair of light receiving faces.

When a light source is energized in the display system of U.S. Pat. No. 5,295,050, light is transmitted to the light receiving faces of the prism. Light is transmitted through the prism to a light emitting face of the prism. A display panel is disposed in front of the prism.

SUMMARY OF THE INVENTION

The present invention provides a new and improved display system having a display panel connected with a housing. A plurality of light sources are disposed in the housing. A plurality of color filters are disposed between the light sources and the display panel.

A first light source of a plurality of light sources is energizeable to transmit light through a first color filter of the plurality of color filters to illuminate the display panel with a first color, for example, red. A second light source of the plurality of light sources is energizeable to transmit light through a second color filter of the plurality of color filters to illuminate the display panel with a second color, for example, green. The first and second light sources are both energizeable to illuminate the display panel with a third color, for example, yellow.

The display panel includes inner and outer layers containing light absorbing pigment and light scattering particulates. The outer layer of the display panel contains a relatively large amount of pigment in addition to light scattering particulates. The inner layer of the display panel includes a relatively large amount of light scattering particulates and a smaller amount of light absorbing pigment.

BRIEF DESCRIPTION OF THE DRAWINGS

The foregoing and other features of the invention will become more apparent upon a consideration of the following description taken in connection with the accompanying drawings wherein.

DESCRIPTION OF THE SPECIFIC PREFERRED EMBODIMENT OF THE INVENTION

General Description

Figure 1:
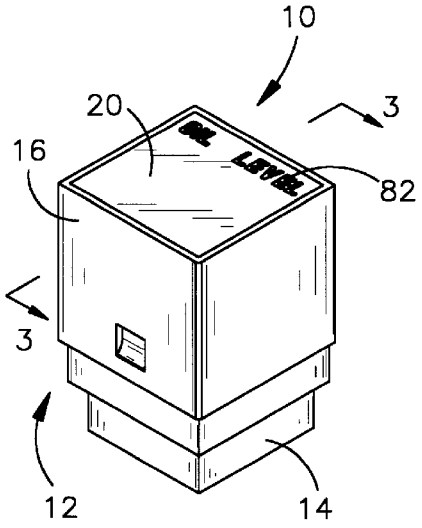
FIG. 1 is a pictorial illustration of a display system constructed in accordance with the present invention.
Figure 2:
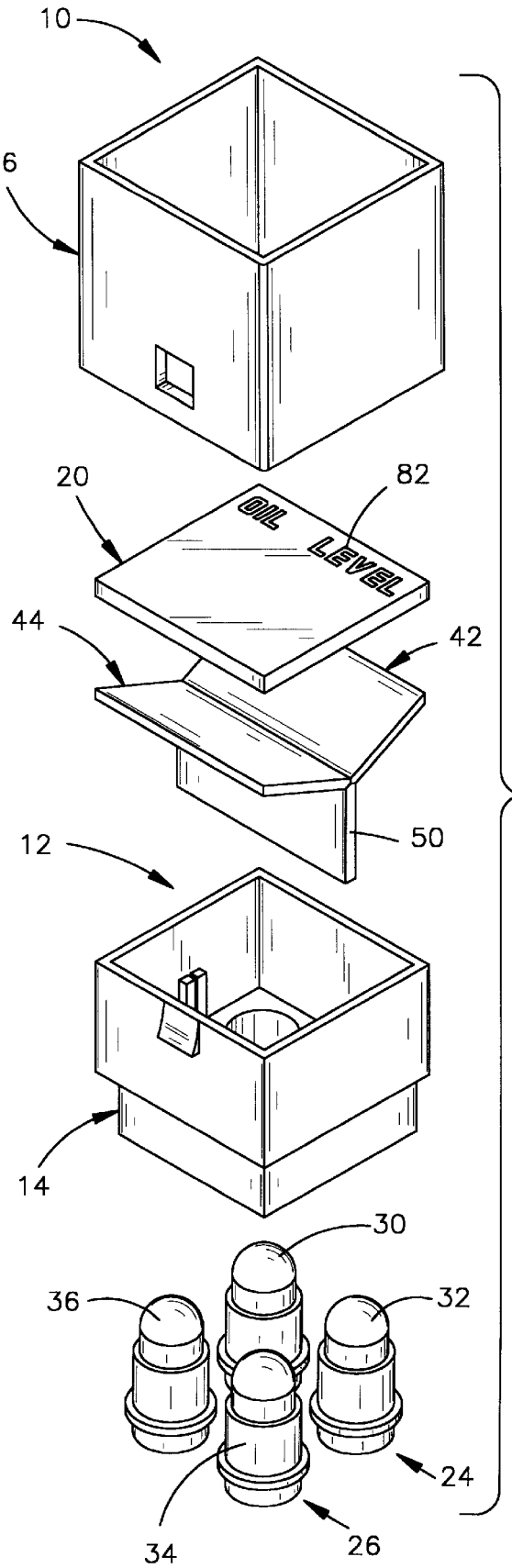
FIG. 2 is an exploded pictorial illustration depicting components of the display system of FIG. 1.

A display system 10 (FIGS. 1, 2 and 3) constructed in accordance with the present invention includes a rectangular housing 12 which includes a base section 14 and a shroud section 16. A rectangular display panel 20 is connected with an upper (as viewed in FIGS. 1–3) end portion of the shroud section 16. A plurality of light sources 24 and 26 (FIGS. 2 and 3) are disposed within the housing 12 on the base section 14.

In the illustrated embodiment of the invention, each of the light sources 24 and 26 (FIGS. 2 and :3) includes a pair of lamps, that is, devices for producing light. Thus, the light source 24 includes lamps 30 and 32. The light source 26 includes lamps 34 and 36. The lamps 30–36 are disposed in a rectangular array on the base section 14. The lamps 30–36 may be solid state devices, such as light emitting diodes, or may be incandescent sources of illumination. Although each of the light sources 24 and 26 includes a pair of lamps, it is contemplated that each of the light sources could contain either a greater or lesser number of lamps if desired.

In accordance with a feature of the present invention, color filters 42 and 44 are disposed between the light sources 24 and 26 and the display panel 20. The color filters 42 and 44 are homogeneous optical mediums that absorb certain regions of the visible spectrum. Thus, the color filters 42 and 44 are used to isolate different regions of the visible spectrum and to pass light of a chosen region quite freely while absorbing all other visible light. In the illustrated embodiment of the invention, the color filter 42 is red color filter which transmits visible light having a wavelength corresponding to the color red. The color filter 44 is a green color filter which transmits light of a wavelength corresponding to the color green. Of course, different color filters could be utilized if desired.

When the light source, 24 is energized, that is, when the lamps 30 and 32 are illuminated, red light is transmitted through the color filter 42 to the display panel 20. This results in the display panel being illuminated in red light. When the light source 26 is energized, that is, when the lamps 34 and 36 are illuminated, green light is transmitted through the color filter 44 to the display panel 20. This results in the display panel being illuminated in green light.

If both light sources 24 and 26 are simultaneously energized, light is transmitted through both color filters 42 and 44. This results in light of primary red and green colors being mixed to illuminate the display panel 20 in yellow light. It is contemplated that colors other than red, green and yellow could be utilized to illuminate the display panel 20 if desired.

It should be understood that the amount of color saturation and purity of the yellow light is dependent upon the spectral transmission characteristics of the red light transmitted by the color filter 42 and the green light transmitted by the color filter 44. The production of the yellow light in this manner requires pairing the spectral transmission properties of the red color filter 42 and the green color filter 44 so as to lessen the propensity of color dominance in the final output color (yellow) and to enhance color purity.

When the display panel 20 is to be illuminated in yellow light, it is preferred to energize only one of the lamps 30 or 32 beneath the, red color filter 42 and only one of the lamps 34 or 36 beneath the green color filter 44. By energizing only one of the lamps in each of the light sources 24 and 26, the brilliance of the yellow light in which the display panel 20 is illuminated is the same as the brilliance of the red or green light in which the display panel is illuminated when both of the lamps in one of the light sources 24 or 26 are energized. When the display panel 20 is to be illuminated in yellow light, uniformity of illumination is promoted by energizing diagonally opposite lamps 30 and 34 or 32 and 36 (FIG. 2) in the rectangular array of lamps.

The base section 14 of the housing 12 includes an opaque divider panel 50 (FIGS. 2 and 3) which is disposed between the two light sources 24 and 26. Therefore, when the light source 24 is energized and the light source 26 is de-energized, light is transmitted through only the red color filter 42 to the display panel 20. At this time, there is no light transmitted through the green color filter 44 to the display panel 20.

Similarly, when the light source 26 is energized and the light source 24 is de-energized, light is transmitted through the green color filter 44 to the display panel 20. At this time, there is no light transmitted through the red color filter 42 to the display panel 20. Of course, when both light sources 24 and 26 are illuminated, a mixture of red and green light, that is, yellow light, is transmitted from the color filters 42 and 44 to the display panel 20.

Figure 3:
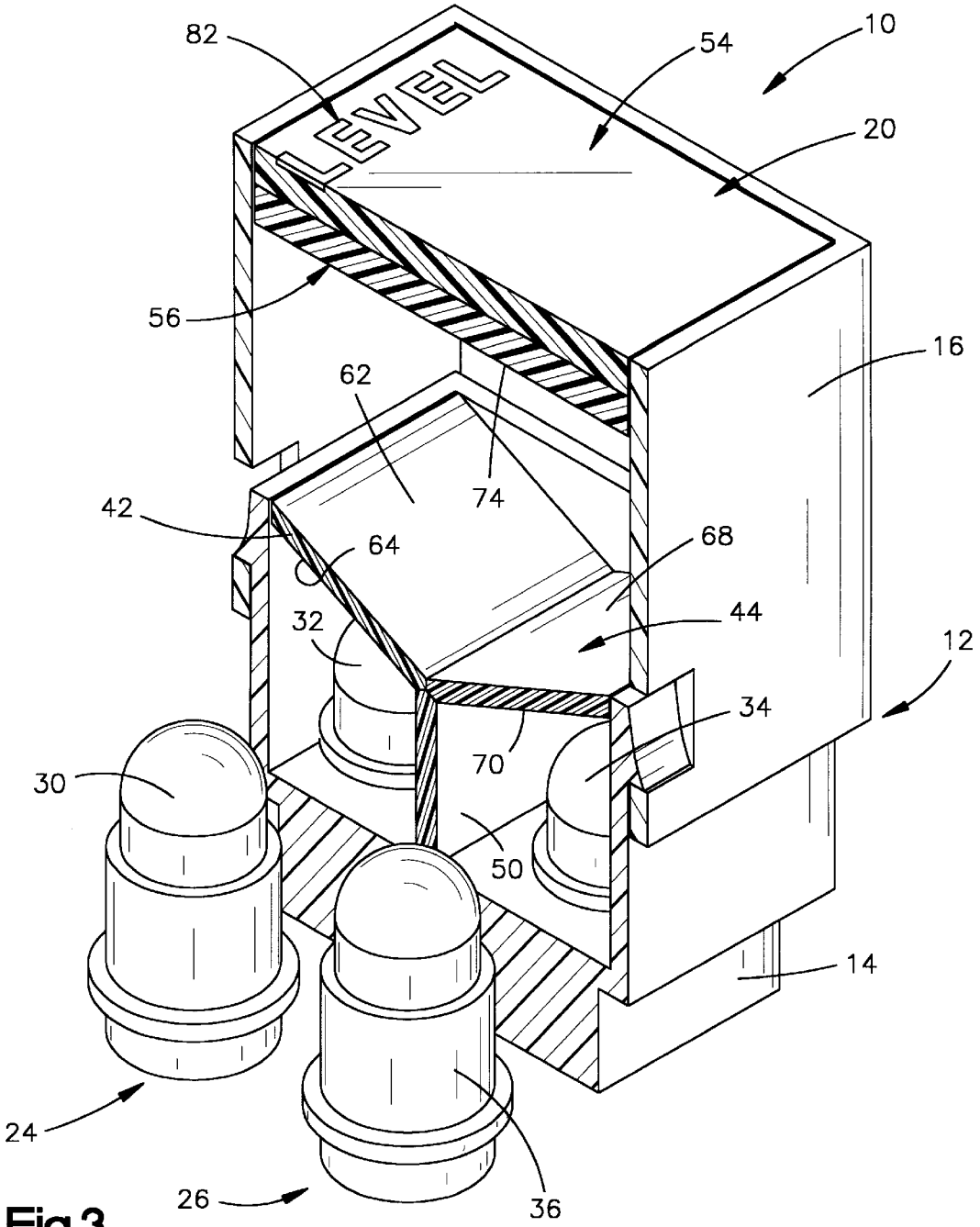
FIG. 3 is a schematic sectional view, taken generally along the line 3—3 of FIG. 1, further illustrating the construction of the display system.
Figure 4:
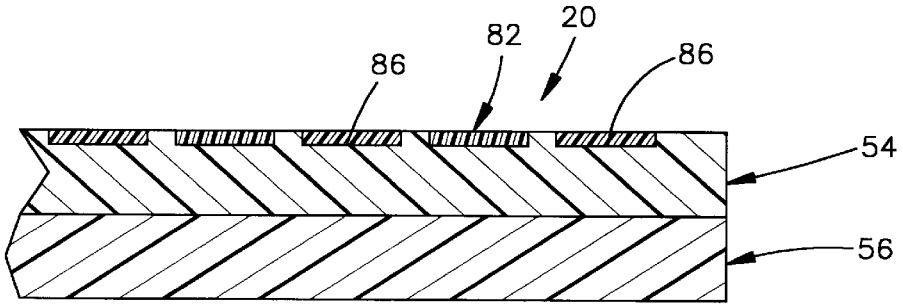
FIG. 4 is a fragmentary sectional view of a portion of a display panel used in the display system of FIGS. 1–3.

In accordance with another feature of the present invention, the display panel 20 includes an outer layer 54 and an inner layer 56 (FIGS. 3 and 4). The outer and inner layers 54 and 56 of the display panel 20 each contain light absorbing pigment and light scattering particulate. The outer layer 54 contains a greater quantity of light absorbing pigment than the inner layer 56. The inner layer 56 contains a greater quantity of light scattering particulate than the outer layer 54.

The relatively large quantity of light absorbing pigment in the outer layer 54 promotes attenuation of direct sunlight to maintain obscurity of the display panel 10 when high ambient incident light is directed at relatively small angles relative to the normal of the display panel. This virtually eliminates any of the reflected light which could cause an observer to perceive false energization of either or both light sources 24 and/or 26.

The inner layer 56 contains a greater quantity of light scattering particulate and a lesser quantity of light absorbing pigment than the outer layer 54. The greater quantity of light scattering particulate in the inner layer 56 enables the inner layer to disperse light from the light source 24 and/or light source 26 to enhance the viewing angle of the display panel 28. The lesser quantity of light absorbing pigment in the inner layer 56 reduces attenuation of light from the light source 24 and/or 26 and thereby enhances the brilliance of the display panel 28 when either or both of the, light sources are energized.

The outer layer 54 and inner layer 56 of the display panel 20 have the same optical density. This enables the two layers 54 and 56 of the display panel 20 to be optically continuous. By forming the display 20 with the outer layer 54 and the inner layer 56 of material having the same optical density, the eye of an observer can not detect a discontinuity between the two layers. Although it is preferred to use a display panel 20 having the foregoing construction, a display panel having a different construction could be utilized if desired.

Color Filters

The color filters 24 and 26 are oriented relative to the display panel 20 so as to promote dispersion of light from the light sources 24 and/or 26 across the inner layer 56 of the display panel 20. The red color filter 42 has a flat rectangular upper major side surface 62. The color filter 42 also has a flat rectangular lower major side surface 64. The parallel upper and lower surfaces 62 and 64 of the red color filter 42 slope downward, that is in a direction away from the display panel 20, toward the green color filter 44. This results in the upper and lower surfaces 62 and 64 of the red color filter 42 being skewed at an acute angle to parallel central axes of the lamps 30 and 32.

When the lamps 30 and 32 are energized, the light from the lamps 30 and 32 is refracted by the color filter 42. Due to the sloping orientation of the upper and lower side surfaces 62 and 64 of the,color filter, the refraction of the white light from the light source 24 results in the light of a red wavelength, which is transmitted through the red color filter 42, being disposed over a relatively large area on the inner layer 56 of the display panel 20.

Similarly, the green color filter 44 has a flat rectangular major upper side surface 68 and a flat rectangular major lower side surface 70 which extends parallel to the upper side surface 68. The upper side surface 68 of the green color filter 44 slopes downward, that is in a direction away from the display panel 20, toward the red color filter 42. The parallel upper and lower surfaces 68 and 70 of the green color filter 44 are skewed at an acute angle to central axes of the lamps 34 and 36. Therefore, upon energization of the lamps 34 and 36, the green color filter 44 refracts the light from the lamps in such a manner as to promote an even distribution of green light on the inner layer 56. If lamps in both light sources 24 and 26 are illuminated, the angular orientation of the color filters 42 and 44 relative to the central axes of the lamps 30–36 would promote an even distribution of yellow light on the inner layer 56 of the display panel 20.

It is contemplated that the color filters 42 and 44 could be oriented so as to slope at many different angles relative to a flat inner side surface 74 on the inner layer 56 of the display panel. However, in the illustrated embodiment of the invention, the upper and lower surfaces 62 and 64 of the red color, filter 42 are skewed at an acute angle of approximately 15° relative to the inner side surface 74 of the display panel 20. Similarly, the upper and lower surfaces 68 and 70 on the green color filter 44 are skewed at an acute angle of approximately 15° to a plane containing the inner side surface 74 of the display panel 20. Since the red color filter slopes downwardly toward the right as viewed in FIG. 3 and the green color filter slopes downwardly toward the left as viewed in FIG. 3, there is an included angle of approximately 150° between the upper surface 62 of the red color filter 42 and the upper surface 68 of the green color filter 44.

The transparent red and green pigmented color filters 42 and 44 were constructed by pouring solutions of pigmented methylmethacrylate in sheet form and allowing the solutions to polymerize. The color transmission properties of the polymerized methylmethacrylate was made to correspond precisely to the desired spectral transmission distribution characteristics for the red color filter 42 and for the green color filter 44. Thus, the spectral transmission characteristics of red pigmented polymerized methylmethacrylate were made to correspond precisely to the spectral transmission distribution characteristics necessary to provide the desired red light when the lamps 30 and 32 are energized. Similarly, the color transmission properties of green pigmented polymerized methylmethacrylate were made to correspond precisely to the spectral transmission distribution characteristics necessary to provide the desired green light when the lamps 34 and 36 are energized. The spectral distribution characteristics of the green and red color filters 42 and 44 are selected to provide optimization of the third color (yellow) when the color filters 42 and 44 are paired during energization of the diagonal pair of lamps 30 and 34 or 32 and 36.

Display Panel

Both the outer layer 54 and the inner layer 56 of the display panel 20 contain light absorbing pigment and light scattering particulate. As the optical density of the suspended non-color (gray) light absorbing pigment increases, in either the outer layer 54 or the inner layer 56, the layer tends to increase in light energy absorption. As the optical density of the suspended light scattering particulate increases in either the outer layer 54 or the inner layer 56, the layer tends to increase in light diffusion. Regardless of the total optical density of the outer layer 54 or inner layer 56, it is preferred to have the optical density of the two layers equal within plus or minus six percent (6%) of the total optical density of the inner layer 56.

In one specific embodiment of the invention, the outer layer 54 was formed of polymerized methyl methacrylate. The light scattering particulates were formed of styrene. The light absorbing pigment was a neutral, non-color pigment. The inner layer 56 was also formed of polymerized methyl methacrylate. The light scattering particulates in the inner layer were formed of styrene. The light absorbing pigment in the inner layer 56 was a neutral gray.

In the specific embodiment of the invention illustrated in FIG. 3, the outer layer 54 contains a non-color (gray) light absorbing pigment having a transmittance of twenty-five percent (25%) to thirty percent (30%). This corresponds to a loss in intensity of 75% to 70%. The outer layer 54 contained light dispersion particulate (styrene) having a transmittance of seventy percent (70%) to eighty-five percent (85%). This corresponds to a loss in intensity of 30% to 15%. The uncorrected product transmittance of the pigment and light dispersion particulate was 17.5% to 25.5%.

The inner layer 56 contained a non-color (gray) light absorbing pigment having a transmittance of fifty percent (50%) to sixty percent (60%). The inner layer contained light dispersion particulates (styrene) having a transmittance of forty percent (40%) to forty-five percent (45%). The uncorrected product transmittance of the inner layer 56 was twenty percent (20%) to twenty-five percent (25%).

After the outer layer 54 and inner layer 56 have been interconnected by diffusion bonding, the uncorrected product transmittance values for the inner and outer layers increased by 10 to 11 percentage points. This is due to the reduction of incidence reflection and polarization effects on the light.

The optical density of the light absorbing pigment in the inner layer 56 is less than the optical density of the light absorbing pigment in the outer layer 54. Thus, the optical density of the light absorbing pigment in the inner layer 56 varies in the range of 2 to 1.66. The optical density of the light scattering particulate in the inner layer 56 is greater than the optical density of the light scattering particulate in the outer layer 54. The optical density of the light scattering particulate in the inner layer 56 varies in a range of 2.5 to 2.22. The uncorrected product optical density of the inner layer 56 varies within a range of 5 to 3.7.

In regard to the outer layer 54, the light absorbing pigment optical density is 4 to 3.3 while the light scattering particulate optical density is 1.43 to 1.18. The uncorrected product optical density for the outer layer 54 is 5.7 to 3.9.

By constructing the outer and inner layers 54 and 56 of the display panel 20 in this manner, a uniform illumination of the display panel 20 is achieved when the light source 24 and/or light source 26 is illuminated. Thus, when the light source 24 is illuminated, a uniform red illumination of the display panel 20 is achieved. When the light source 26 is illuminated, a uniform green illumination of the display panel 20 is achieved. When both light sources 24 and 26 are illuminated, a uniform yellow illumination of the display panel 20 is achieved.

Indicia

In the illustrated embodiment of the invention, indicia 82 is provided in association with the display panel 20. The indicia 82 is non-self luminous indicia which is provided as a labeling element for the function of the display panel 20. The non-self luminous indicia 82 is readable only when sufficient ambient light conditions exist. The readability of the indicia 82 remains unchanged throughout the energized and non-energized states of the light source 24 and/or the light source 26. However, it is contemplated that the display system 10 could be constructed to provide illumination for viewing of the indicia 82 when ambient light is such that it does not provide adequate illumination for an observer to reach the indicia by reflective means alone, for example, during nighttime viewing. If this was done, light could be conducted from the light sources 24 and/or 26 to the indicia through the use of fiberoptics and/or other known devices.

The indicia 82 is provided by deposition of pre-mixed methylmethacrylate solution into cut sections or recesses 86 (FIG. 4). The optical density of the solution deposited in the recesses 86 can be determined either by formulation of the solution prior to deposition or by mechanical means to reduce material thickness after polymerization. A completely opaque material formulation is deposited in the recesses 86 to create white indicia that provides high reflectivity and adequate,contrast for excellent day time readability. Of course, if desired, the transmittance properties of the indicia 82 could be adjusted to provide some light transmission during lamp energization.

If desired additional indicia could be provided at the display panel 20. For example, a translucent indicia layer could be provided between the outer and inner layers 54 and 56 of the display panel 20. The indicia layer would include a portion having a relatively high optical density and a portion having a relatively low optical density. The areas of high and low optical density would define the indicia. The relatively large quantity of light absorbing pigment in the outer layer 54 would promote attenuation of direct sunlight to maintain obscurity of the indicia when the light sources 24 and 26 are de-energized.

Conclusion

In view of the foregoing description, it is clear that the present invention provides a new and improved display system 10 having a display panel 20 connected with a housing 12. A plurality of light sources 24 and 26 are disposed in the housing 12. A plurality of color filters 42 and 44 are disposed between the light sources 24 and 26 and the display panel 20.

A first light source 24 of a plurality of light sources is energizeable to transmit light through a first color filter 42 of the plurality of color filters to illuminate the display panel 20 with a first color, for example, red. A second light source 26 of the plurality of light sources is energizeable to transmit light through a second color filter 44 of the plurality of color filters to illuminate the display panel 20 with a second color, for example, green. The first and second light sources 24 and 26 are both energizeable to illuminate the display panel 20 with a third color, for example, yellow.

The display panel 20 includes inner and outer layers 54 and 56 containing light absorbing pigment and light scattering particulates. The outer layer 54 of the display panel 20 contains a relatively large amount of pigment in addition to light scattering particulates. The inner layer 56 of the display panel 20 includes a relatively large amount of light scattering particulates and a smaller amount of light absorbing pigment.

Having described the invention, the following is claimed:

1. A display system comprising a housing, a display panel connected with said housing, said display panel includes inner and outer layers containing light absorbing pigment and light scattering particulate, each unit volume of said outer layer of said display panel containing a greater quantity of light absorbing pigment than a corresponding unit volume of said inner layer, each unit volume of said inner layer of said display panel containing a greater quantity of light scattering particulate than a corresponding unit volume of said outer layer, a plurality of light sources disposed in said housing, and a plurality of color filters disposed in said housing between said light sources and said display panel, a first light source of said plurality of light sources being energizeable to transmit light through a first color filter of said plurality of color filters to illuminate said display panel with a first color, a second light source of said plurality of light sources being energizeable to transmit light through a second color filter of said plurality of color filters to illuminate said display panel with a second color, said first and second light sources being simultaneously energizeable to simultaneously transmit light through said first and second color filters to illuminate said display panel with a third color.

2. A display system as set forth in claim 1 wherein said first color filter has a major side surface area which slopes in a direction away from said display panel and toward said second color filter, said second color filter has a major side surface area which slopes in a direction away from said display panel and toward said first color filter.

3. A display system as set forth in claim 1 further including an opaque wall structure blocking transmission of light from said first light source through said second color filter and blocking transmission of light from said second light source through said first color filter.

4. A display system as set forth in claim 1 wherein said inner and outer layers of said display panel have the same optical density.

5. A display system as set forth in claim 1 wherein said first and second layers of said display panel are interconnected at a location which is free of optical discontinuities.

* * * * *